US006109448A

United States Patent [19]

Konetzka et al.

[11] Patent Number: 6,109,448

[45] Date of Patent: Aug. 29, 2000

[54] VERTICAL-AXIS AIR CLASSIFIER

[75] Inventors: Georg Konetzka; Marcus Alex Heinrich Adam; Stefano Zampini, all of Augsburg, Germany

[73] Assignee: Hosokawa Alpine Aktiengesellschaft, Augsburg, Germany

[21] Appl. No.: 08/953,721

[22] Filed: Oct. 17, 1997

[30] Foreign Application Priority Data

| | | | |
|---|---|---|---|
| Oct. 18, 1996 | [DE] | Germany | 196 43 068 |
| Oct. 18, 1996 | [DE] | Germany | 196 43 042 |
| Oct. 18, 1996 | [DE] | Germany | 196 43 043 |
| Oct. 18, 1996 | [DE] | Germany | 196 43 023 |

[51] Int. Cl.[7] ..... B07B 4/00; B04B 5/12

[52] U.S. Cl. ..... 209/135; 209/143; 209/710; 209/714

[58] Field of Search ..... 209/133, 142, 209/143, 146, 147, 148, 710, 713, 714, 135

[56] References Cited

U.S. PATENT DOCUMENTS

| | | | |
|---|---|---|---|
| 2,046,442 | 7/1936 | Baldwin | 209/713 X |
| 2,329,900 | 9/1943 | Hermann | 209/148 X |
| 3,371,783 | 3/1968 | Meyer et al. | 209/148 X |
| 4,560,471 | 12/1985 | Yamada et al. | 209/148 X |
| 4,756,428 | 7/1988 | Jaeger | 209/135 |
| 5,025,930 | 6/1991 | Barthelmess | 209/144 |
| 5,158,182 | 10/1992 | Fischer-Helwig | 209/135 |
| 5,377,843 | 1/1995 | Schumacher | 209/139.2 |

FOREIGN PATENT DOCUMENTS

| | | | |
|---|---|---|---|
| 654 741 | 12/1937 | Germany . | |
| 894 803 | 9/1953 | Germany . | |
| 196 29 924 A1 | 2/1977 | Germany . | |
| 35 21 638 A1 | 12/1986 | Germany . | |
| 37 12 136 C1 | 12/1986 | Germany . | |
| 36 38 915 C2 | 7/1987 | Germany . | |
| 290 151 A5 | 5/1991 | Germany . | |
| 41 12 018 | 12/1991 | Germany . | |
| 41 40 656 | 9/1992 | Germany . | |
| 40 14 342 C2 | 6/1994 | Germany . | |
| 44 16 034 A1 | 7/1995 | Germany . | |
| 195 13 745 A1 | 10/1996 | Germany . | |
| 6-142615 | 5/1995 | Japan . | |
| 1238816 | 6/1986 | U.S.S.R. | 209/148 |

*Primary Examiner*—Tuan N. Nguyen
*Attorney, Agent, or Firm*—Pennie & Edmonds LLP

[57] ABSTRACT

A vertical-axis air classifier having a central product feed, a drive shaft, a tangential classifying air supply inlet located on a level with the rotor, a stationary guide vane ring arranged at a radial distance around the periphery of the rotor, a deflector-wheel rotor with one-sided bearing as well as a housing with fine material and coarse material discharge. The drive shaft, an annular-shaped fines discharge chamber arranged coaxially to the drive shaft, an annular-shaped coarse material discharge chamber arranged coaxially to the drive shaft and the bearing for the rotor are arranged on the same side and beneath the rotor to permit ease of cleaning and dismantling.

23 Claims, 4 Drawing Sheets

VERTICAL-AXIS AIR CLASSIFIER

BACKGROUND OF THE INVENTION

The invention involves a vertical-axis air classifier with central product feed, with a tangential classifying air supply inlet located on a level with the rotor, with a stationary guide vane ring arranged at a radial distance around the periphery of the rotor, with an annular-shaped classifying zone delimited by a deflector-wheel rotor with one-sided bearing and a vane guide ring located coaxially at a radial distance to the outer periphery of the rotor, with a drive shaft for the rotor with one-sided bearing as well as a housing with fine material and coarse material discharge.

An air classifier of this design, where the material to be classified is set into rotary motion by a wheel which rotates around an axis and the classifying air flows centripetally to distribute the rotating material uniformly over the periphery of the classifying wheel to the classifying zone, is already known from the German patent application DE 35 21 638 A1.

The material to be classified is charged centrally to the classifier, is then distributed over a large surface area by a centrifugal plate and routed as a bell-shaped cloud of product over the periphery of the rotor past the classifying wheel vanes. The classifying air flows through the classifying wheel in centripetal direction; the fines are routed to the inside of the rotor. Gravity causes the rejected coarse material to move downwards, where it deposits in an annular-shaped coarse material discharge chamber.

The air flow pattern through the classifying zone is centripetal. The rotating deflector wheel deflects the coarse material radially to the outside and conveys the fines together with the classifying air to the inside of the rotor. The classified fines are then deflected axially downwards and finally discharged from the rotor.

The drive and bearing of the rotor are arranged above the rotor on the same side as the central product feed.

The specification of achieving a steady and continuous product feed is resolved fairly well here by the central product feed. Because the area above the centrifugal plate of the rotor must be kept clear for the central product feed, this design has the drive and bearing located in the same zone. The current state of the art permits only an unsatisfactory arrangement of central product feed, drive and bearing with the aid of a hollow drive shaft. This design, especially that of the bearing, is particularly complex and only suitable for low speeds and moreover extremely difficult to install.

A further disadvantage of this classifier is the discharge of the coarse material, which is executed with the aid of a feed channel which runs downwards at an angle. The task of this feed channel is to route the coarse material which enters and distributes throughout the entire coarse material discharge chamber to a discharge socket located at only one point around the periphery of the coarse material discharge chamber.

For the classifier designed in accordance with this state of the art, the problem of the coarse material discharge has been satisfactorily resolved. Disadvantageous, however, is that the axial feed channel must be large in dimension.

Another state-of-the-art design with central product feed from above is described in the German patent DE-PS 894 803. The main feature of this air classifier is the one-sided rotor bearing with a fines discharge located on the drive side. The feed material is fed centrally above the closed cover plate of the rotor. With the vertical arrangement of rotor and drive shaft, the cover plate acts as a centrifugal plate and distributes the feed material uniformly across the entire extent of the rotor. This results in a uniformly distributed cloud of product which flows over the periphery of the rotor.

The classifying air flows through the rotor centripetally and transports the fines to the inside of the rotor, whereas the coarse material is rejected by the rotating vanes. The classified fines are ultimately discharged from the rotor in centrifugal direction.

In the case of the air classifier built in accordance with this state of the art, the cover plate is supported together with the classifying wheel vanes by an extended section of the drive shaft which penetrates the rotor. The disadvantage here is that the inside of the rotor is thus not completely free from fittings and this hinders an ideal flow pattern in the inside of the rotor.

Another disadvantage is that the fines discharge is not reliably sealed off from the classifying zone, so that spatter grain can contaminate the already classified fines by entering through the gap between the classifying wheel vanes and the housing.

The design is not very stable altogether and removal plus installation of the rotor in the housing is extremely difficult. Such an air classifier is particularly unsuitable for high speeds.

Air classifiers are known, for example, from the German patent DE-PS 36 38 915 C 2—which besides a rotor that is driven on one side also have a fines discharge that leads axially downwards.

However, the coarse material discharge is still arranged on the same plane as the classifying wheel vanes and leads to the outside in radial direction. The assembly effort with this design is fairly high and cleaning is extremely time-consuming.

With the newer classifiers, especially those used for high-tech products, great store is laid by the ease of dismantling the entire classifier and by the ease of cleaning. This is particularly important for pharmaceutical products, pigments, ultrafine powders and toner.

With the above-mentioned materials, the batches tend to be on the small side and the product is changed frequently. It is therefore obvious that the ease of cleaning and dismantling is a major requirement.

This requirement demands a compact and space-saving classifier design where the zones such as classifying air supply, fines discharge and coarse material discharge are positioned close to each other.

To permit thorough cleaning of the inside of the classifier, it must be completely dismantled into its component parts. But because of the fact that the functional connections such as drive, bearing, product feed, fines discharge and coarse material discharge are scattered around the circumference of the classifier, this is particularly difficult.

With state-of-the-art classifier housings, the cleaning apertures are window-like openings located usually on the side of the classifier housing. The horizontal removal of product deposits from these lateral apertures is, however, extremely difficult because any product deposits dislodged from the inside walls of the classifier housing tend to fall vertically downwards as a result of the force of gravity, and not through the horizontally positioned cleaning apertures.

In the case of a classifier of this design with a relatively short axial extent of the classifying wheel and a product circulation system whereby the product is only presented to the classifying wheel once, it is disadvantageous if the residence time of the product in the classifying zone is too short. The quality of the coarse material suffers because it is conceivable that not all the fines are separated out of the material and thus the fines portion in the discharged coarse material is still relatively high.

With classifiers of this type, the material to be classified is routed from top to bottom along the rotor by the effects of gravity. Except for the radial turbulence, the feed material essentially follows the path of gravity downwards. This means that the feed material is only presented to the classifier once and then only for a brief period. Because of the short residence time of the material in the classifier, the fines cannot be diverted out of the material stream and classified in their entirety. The rejected coarse material fraction thus still contains a high proportion of fine particles. As a result of this, the coarse material quality falls short of optimal.

In addition, the vertical arrangement of the classifier and the resultant downwards flow direction of the feed material leads to a fluctuating concentration of material in the classifying zone, which in turn means that it is not possible to optimally utilize the entire length of the rotor.

Because with conventional classifiers, a mixture of fresh feed material and already classified product occurs in the outside classifying zone, the residence time of individual particles varies greatly with negative consequences for the quality of classification. The residence time, however, is an important parameter for the classification quality. It dictates the number of times the particles make contact with the classifying wheel or the guide vanes and thus the probability of the fine particles being dislodged from the coarse particles.

Another problem with conventional classifiers is the tendency of the fluid-particle suspension to separate into a force field. This can lead locally to particle concentrations which are too high. And the more concentrated the particles, the harder it is to separate the fines from the material being classified. This also has an adverse effect on the quality of classification.

SUMMARY OF THE INVENTION

The object of the invention, therefore, is to provide a vertical air classifier with central product feed and centrifugal plate by which the entire configuration of the rotor, bearing, drive and housing is constructed in such a way that the rotor is stable over the entire speed range, and simultaneously a favorable flow pattern is promoted. Also, a simple removal and installation of the rotor in the classifier housing is facilitated, which guarantees easy cleaning and allows the working chambers to be sealed off efficiently.

The invention-design solves this task by having the drive shaft, an annular-shaped fines discharge chamber, an annular-shaped coarse material discharge chamber and the classifier wheel bearing arranged on the same side of the machine underneath the rotor.

The fundamental idea of the invention-design classifier, therefore, is to have all functional connections on one side of the machine. The product feed constitutes an exception, because a central product feed from above has proved to be ideal.

Because all the functional connections are arranged in vertical direction underneath the classifying wheel, the classifying wheel can be easily accessed from above via a cover in the classifier housing. Merely the top housing cover needs to be removed to permit dismantling the invention-design air classifier.

The rotor is connected via a special support to the drive shaft in a detachable manner. In a preferred design, the method of attachment is via one central screw. After undoing this one screw, the rotor can be pulled off the drive shaft and removed axially from the classifier housing in upwards direction.

The primary task of the support is to transmit the torque from the drive shaft to the rotor. At the same time, the support also completely supports the rotor. This design permits the space inside the rotor to remain completely clear.

The flow-favorable openings in the support serve to transport the classified fines away from the inside of the classifying wheel. The load-bearing ribs of the support can be streamlined in design to prevent decelerating or otherwise hindering the flow on the one hand, and to generate a fan effect to accelerate the fines out of the inner zone along with the classifying air on the other hand.

Suitable rib shapes are profiled cross-sections which can also display spatial curves and thus act as a discharge guide device. This permits optimization of the air flow efficiency.

Suitable selection of the support's inside diameter in the transition zone between the classifying wheel vane ring and the openings in the support make the support act in the same way as an orifice plate.

The outside periphery of the transition zone is designed as a sealing surface, thus permitting a perfect seal between the classifying chamber and the fines discharge. In a preferred invention design, the seal is one which can be rinsed with a fluid.

The inside walls of the classifier housing are designed to provide good accessibility. With the rotor removed, the classifier housing can be easily cleaned from above. Product deposits on the inside walls of the classifier housing can also be removed easily. Any material which falls to the floor of the classifier housing in the process can be vacuumed out.

This classifier design is a much simplified version of the current state of the art. The invention-design rotor has no undercuts, meaning that with the exception of the upper housing cover, the classifier housing need not be dismantled.

In order to permit controlling the residence time and the concentration of product in the classifying chamber and thus to make it possible to separate out a greater portion of the fines through the rotor and thus to optimize the coarse material quality, the classifier is equipped with a helix which runs coaxially to the classifying wheel and which extends into the annular-shaped classifying chamber. The idea is to influence the residence time of a product introduced into the classifier.

A new helix in the classifying chamber also permits the particle concentration in the area of the classifying wheel to be regulated in a controlled manner. This makes it possible to prevent undesirable particle concentrations.

Use of such an invention-design helix thus helps to control not only the residence time, but also the concentration of the particles.

These effects are achieved by inserting one or more helices between the classifying wheel and the guide vane ring. The helices convey the feed material rotating in the classifying chamber between the guide vanes and the classifying wheel. The conveying effect can be adjusted as a function of the helix pitch. Increasing the pitch as the helix approaches the coarse material discharge intensifies the conveying effect and thus shortens the residence time. Whereas if the pitch is decreased until the angle is negative—i.e. the conveying effect is aimed towards the product feed inlet—the product will be conveyed upwards against the force of gravity and an additional final classification effect of the coarse material is obtained.

Dependent on the problem specification, the pitch of the helix can be varied in individual sections over the entire height of the classifying wheel. This results in a variation of the residence time of the product over the entire height of the classifying wheel.

For example, the feed material can be drawn in quickly by having a helix section with steep pitch in the upper section of the classifying wheel, be subjected to a long residence time in the central section by means of a less acute helix pitch (or a final classification effect by having a negative pitch), and in the bottom part of the classifying wheel, a quick discharge of the classified coarse material can be achieved by a helix section with steep pitch.

The control of the particle concentration is a function of determining the number of helices. In view of the fact that with the invention-design classifier, the feed material is generally fed uniformly across the entire radius of the classifying wheel, every single helix comes into contact with part of the total amount of material being classified. The maximum particle concentration is thus limited by the number of helices. To alter the particle concentration in individual sections over the entire height of the classifying wheel, the number of helices can be varied.

The helices need not necessarily extend over the entire height of the classifying wheel but can also be arranged in partial sections over the height of the classifying wheel.

The invention-design classifier also has a flat annular disc located beneath the rotor which extends across the entire floor of the annular-shaped coarse material discharge chamber. Compared with other solutions, this has major advantages.

If the invention-design annular disc is equipped with scrapers attached firmly to the surface of the annular disc, this may intensify the transport effect, but it also poses the risk of the classified coarse material being comminuted by the scrapers and thus adversely affecting the coarse material quality.

If the quality of the coarse material is of no special importance, such scrapers can facilitate a high coarse material throughput.

Another possibility is to introduce an additional air flow which would exercise a desirable transport effect on the coarse material. This air flow, however, would have to be so intense that it would adversely affect the classification because of the compact design of the classifier.

An additional invention idea is to fluidize the classified coarse material by means of an additional air flow and to transport it to the coarse material discharge by means of a rotating annular disc. An additional, fixed disc prevents the classified coarse material from flowing back into the classifying chamber.

BRIEF DESCRIPTION OF THE DRAWINGS

With the aid of the figures, the invention is described in more detail below.

DETAILED DESCRIPTION OF THE INVENTION

Figure 1:
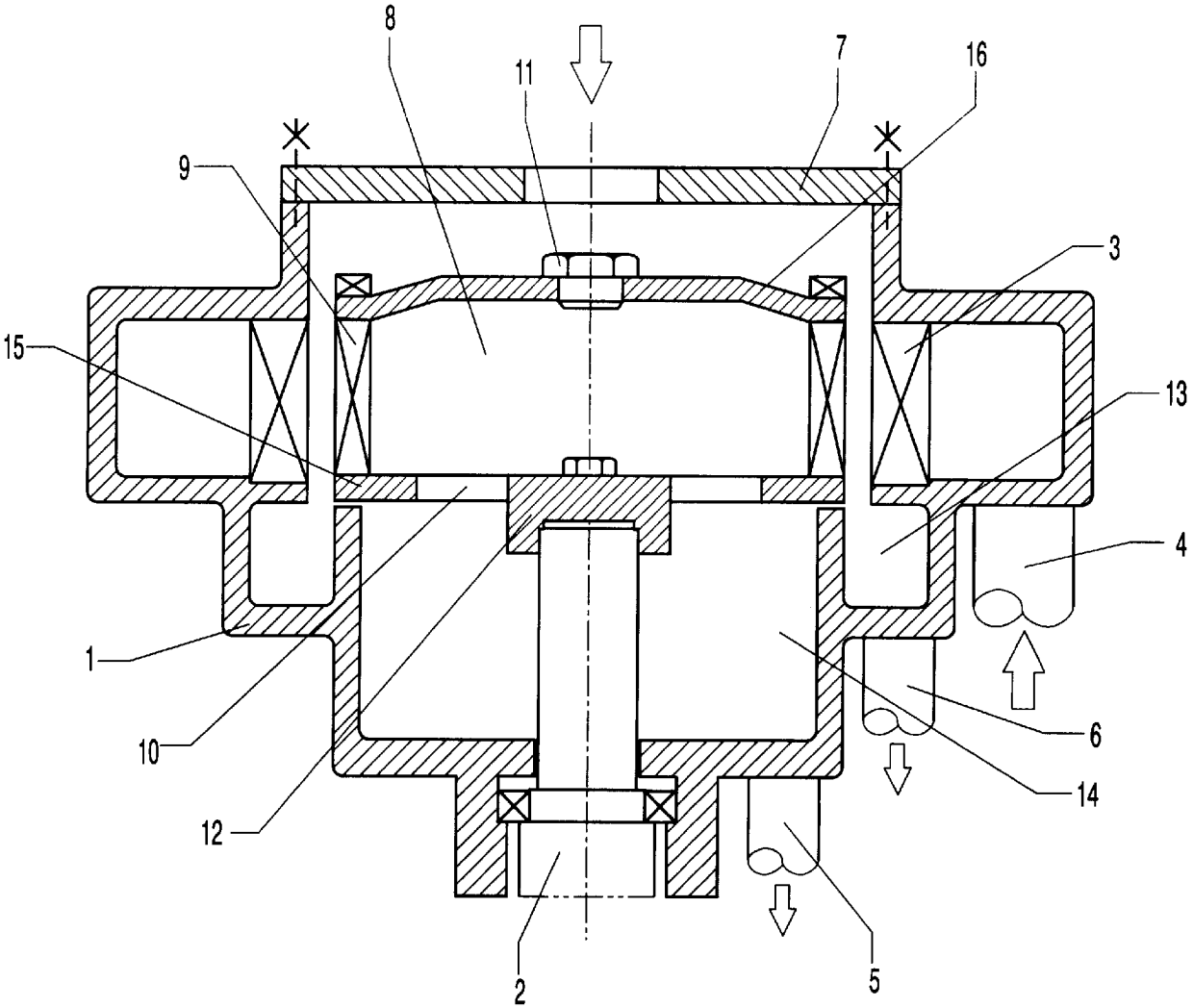
FIG. 1 shows a cross-section through the air classifier of the invention with enclosed drive shaft.

With the air classifier in FIG. 1, the drive shaft 2 is supported at the lower end of the housing 1. The drive shaft 2 penetrates the housing 1 and accommodates the classifying wheel or rotor 8 at its top end. Within the housing 1, the stationary guide vane ring 3 is arranged on a level with the classifying wheel vane ring 9.

The complete rotor 8 is attached to the drive shaft 2 in a detachable manner by means of the assembly screw 12. Designed as a centrifugal plate 16, the cover disc of the rotor 8 is sealed by a quick-disconnect cover screw 11 to permit access to the assembly screw 12 so that the complete rotor 8 can be detached from the drive shaft 2.

The classifying air is supplied through the classifying air inlet 4 behind the guide vane ring 3. Within the housing 1, the annular-shaped coarse material discharge chamber 13 and the annular-shaped fines discharge chamber 14 are located beneath the classifying wheel vane ring 9 coaxially to the drive shaft.

The bottom cover plate 15 of the rotor 8 has apertures which permits the fines to discharge from the inside of the rotor 8 to the fines discharge chamber 14.

Figure 2:
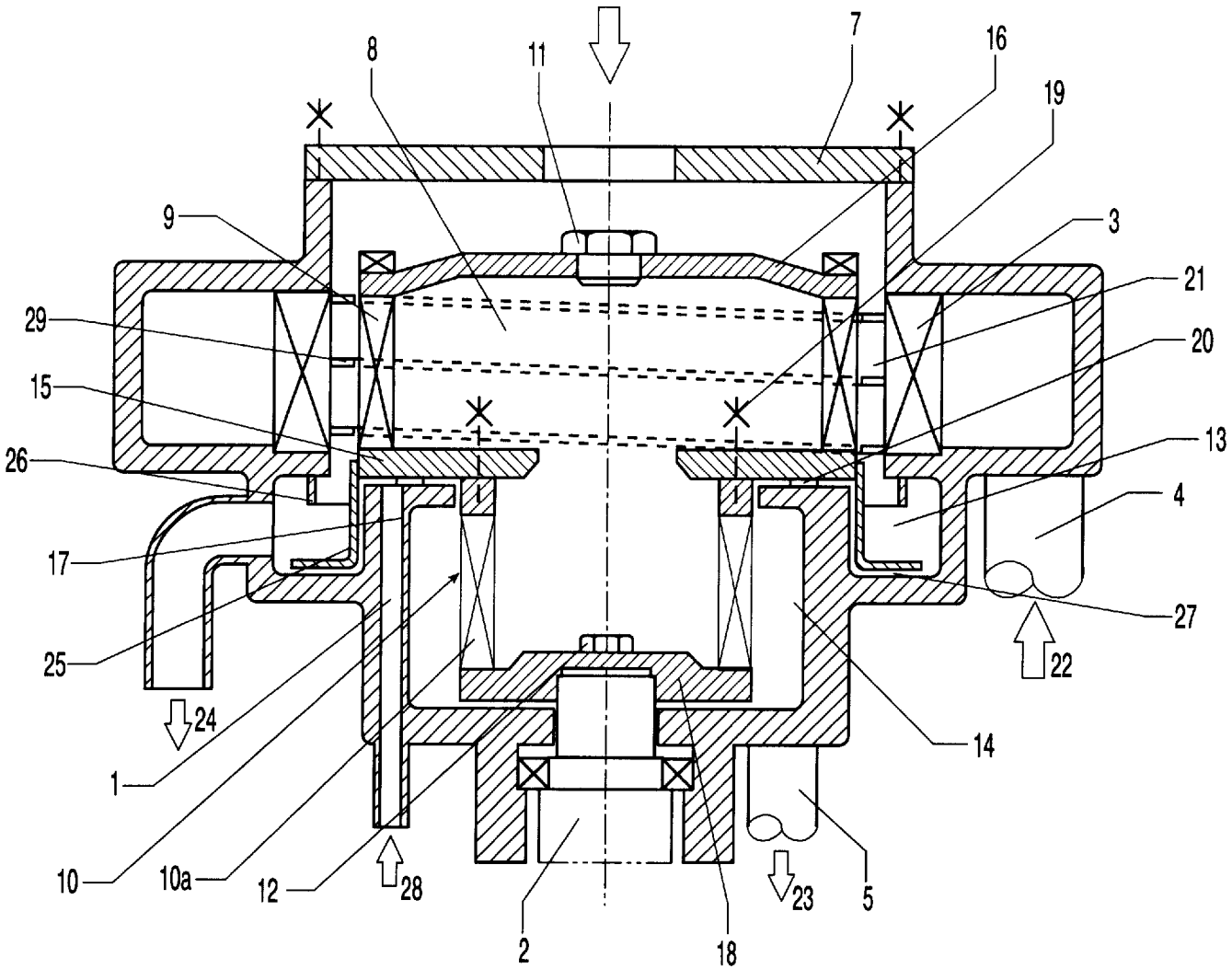
FIG. 2 shows a cross-section through a modified embodiment of the air classifier of the invention with interrupted drive shaft.

With the air classifier in FIG. 2, the drive shaft 2 is interrupted at the point where it penetrates the fines discharge chamber 14 and is replaced there by the perforated support 10. This permits the fines to discharge from the inside of the classifying wheel 8*a* to the fines discharge chamber 14.

The support 10 comprises the bottom disc 18, the annular plate 17, and the streamlined circumferentially spaced spacer ribs 10*a*, which together form a connecting element between the drive shaft 2 and the classifying wheel 8 and which define the apertures for discharge of the fines from the inside of the classifying wheel 8.

The classifying wheel 8 comprises the classifying wheel vane ring 9, the centrifugal plate 15 and the coder plate 16, and is connected finely to the support 10. This connection can be in severable design in the area of the plates 15 and 17 and can have screws 19 inserted uniformly around the periphery of the rotor.

In the area of the plates 15, 17 and the housing 1 is a fluid-rinsable seal 20 shown in axial arrangement which reliably separates the classifying chamber 21 from the fines discharge chamber 14.

In the axial transition area between the classifying wheel 8 and the support 10, the bottom cover plate 15 projects over the inside periphery of the annular plate 17 and thus over the support 10 into the inner zone, thus forming an orifice plate with throttle effect in the transition area.

The product is fed to the cover plate 16 of the rotor 8, which forms a centrifugal plate. The annular channel which runs between the outside of the classifying wheel 8 and the inside of the guide vane ring 3 forms the classifying chamber 21 over the entire height of the classifying wheel 8.

The feed material flows through the classifying chamber 21 vertically. To permit control of both the classifying material concentration in the classifying chamber 21 and the residence time, a helix 29 extends over almost the entire radial width of the classifying chamber 21 and over the entire height of the classifying wheel 8. In the design shown in the figure, a single helix with constant pitch is employed.

The flow direction of the classifying air is perpendicular to the stream of feed material. From the classifying air inlet 22, the classifying air flows horizontally through the stationary guide vane ring 3 into the classifying chamber 21 and flows through the chamber at right angles to the flow of feed material.

The classified fines are discharged axially through the fines discharge 23 along with the classifying air. The classified coarse material is discharged through the coarse material discharge chamber 13 under the classifying chamber 21 and exit through the coarse material discharge 24.

The coarse material discharge ring 25 is fixed securely to the classifying wheel 8 and rotates within the coarse material discharge chamber 13. The stationary retaining ring 26 is located above the coarse material discharge chamber 13 and is fixed securely to the housing 1.

Between the floor of the coarse material discharge chamber 13 and the coarse material discharge ring 25 is the aperture 27 for supplying the rinsing air 28.

Figure 3:
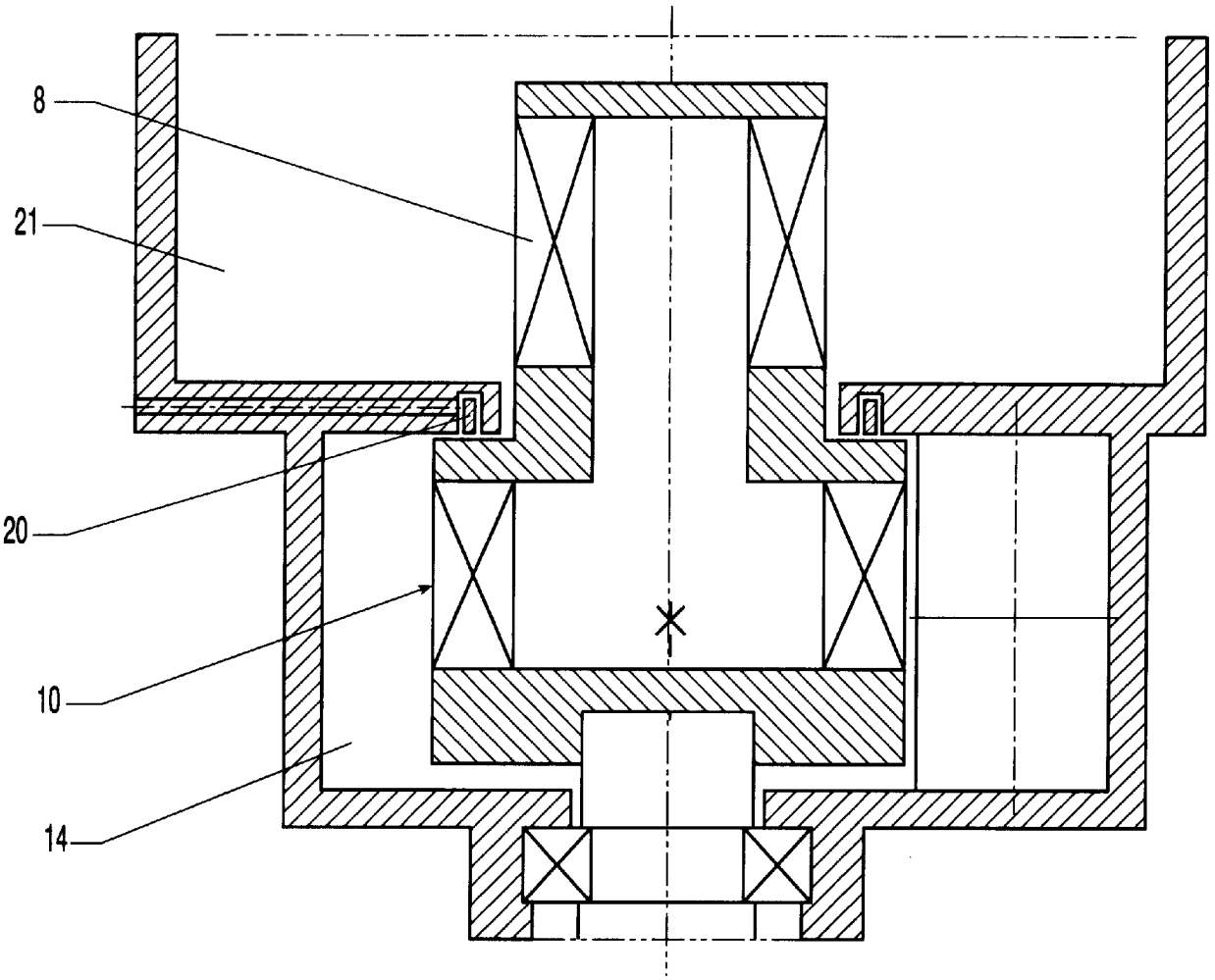
FIG. 3 is a cross sectional view of an air separator according to this invention, with a radial seal that permits fluid flushing and with different outer diameters of the separating rotor and the support system.

FIG. 3 illustrates another embodiment of the classifier with the fluid-flushable seal 20 mounted in an axial position. In this case, the outer diameter of the support assembly 10 is larger than the outer diameter of the separating rotor 8.

Figure 4:
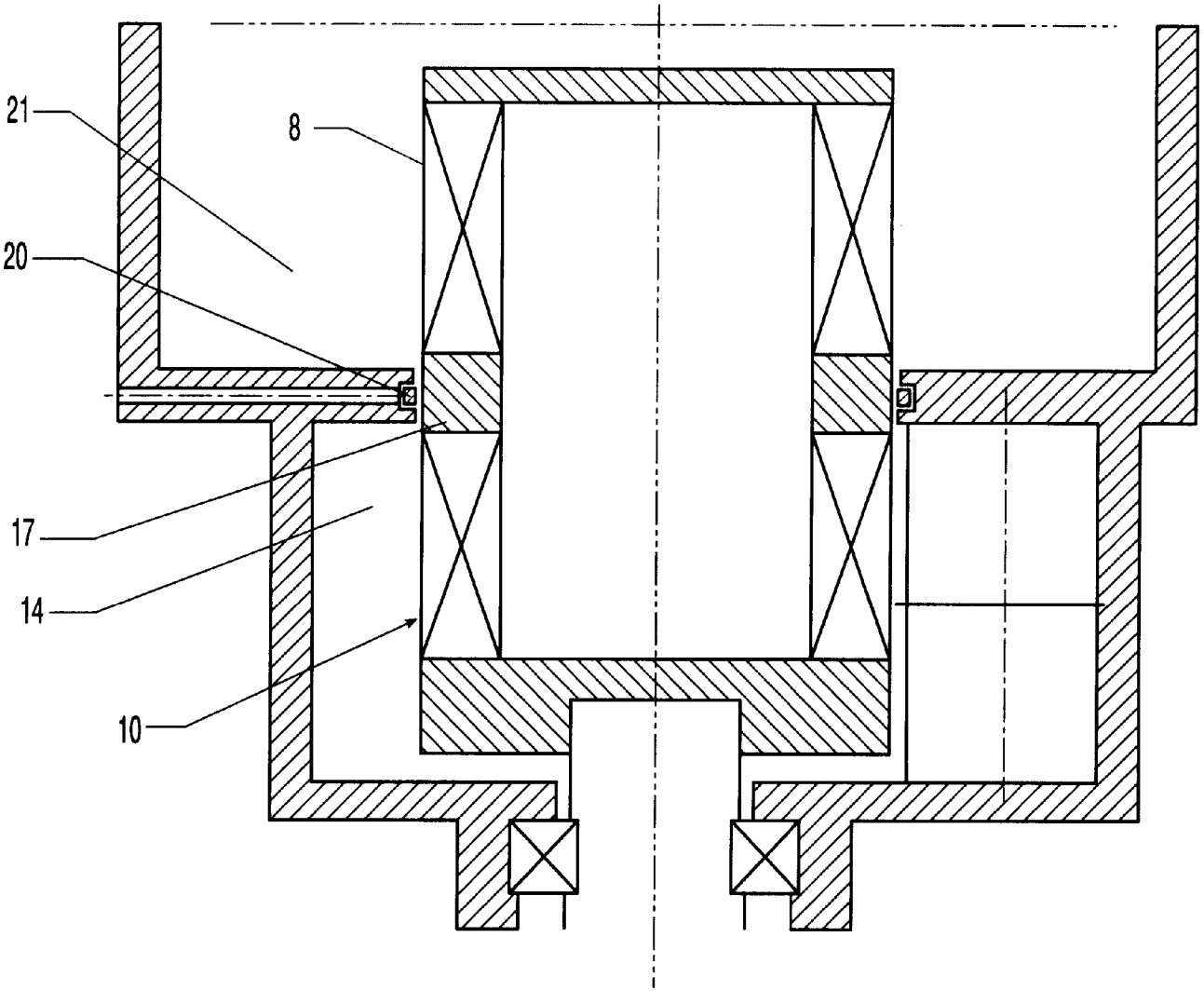
FIG. 4 is a cross-sectional view of an air separator according to this invention, with a radial seal that permits flushing with a fluid.

FIG. 4 illustrates an embodiment of the classifier with the fluid-flushable seal 20 mounted in a radial position on the outer perimeter of the circular disk and reliably isolating the separating chamber 15 from the fine-material discharge chamber 16.

What is claimed is:

1. In the vertical-axis air classifier having a central top product feed, a rotor having a rotor surface area with apertures extending therethrough and further having a vertical rotor axis and an inside flow zone, a tangential classifying air supply inlet located on a level with said rotor, a stationary guide vane ring having an inside surface and arranged at a radial distance around the periphery of the rotor, an annular-shaped classifying zone delimited by said rotor and said inside surface of said vane guide ring, a drive shaft for said rotor with one-sided bearing, and a housing with fine material and coarse material discharge chambers, the improvement comprising:

a) said fines material discharge chamber and said coarse material discharge chamber both being annular in shape and disposed coaxially to said drive shaft; and b) said drive shaft, chambers and bearing all being located on the same side of and underneath the rotor.

2. Vertical-axis air classifier according to claim 1, wherein the coarse material discharge chamber is located directly under the classifying zone.

3. Vertical-axis air classifier according to claim 2, wherein the coarse discharge chamber connects to a coarse discharge outlet which extends axially downwardly.

4. Vertical-axis air classifier according to claim 1, wherein the fines discharge runs axially downwards from the inside flow zone of said rotor.

5. Vertical-axis air classifier according to claim 1, wherein the drive shaft is connected with the rotor for transmitting torque to said rotor and has a hollow portion including at least one aperture in communication with the rotor constructed to permit the flow and discharge of fines material from the rotor through the hollow portion.

6. Vertical-axis air classifier according to claim 5, wherein the said support includes a circumferential surface with slots extending in an axial direction relative to said drive shaft for permitting the flow and discharge of fines therethrough.

7. Vertical-axis air classifier according to claim 6, wherein the slots in axial direction are distributed uniformly around said circumferential surface.

8. Vertical-axis air classifier according to claim 7, wherein at least 20% of the circumferential surface of the support includes said slots.

9. Vertical-axis air classifier according to claim 8, wherein the percentage of the circumferential surface area which has said slots is at least as great as the percentage of the rotor's surface which has apertures.

10. Vertical-axis air classifier according to claim 5, wherein the rotor is attached to the support in a detachable manner.

11. At Vertical-axis air classifier according to claim 5, wherein an orifice plate providing a throttle effect is located in the inside flow zone of the rotor at a transition zone between the rotor and the support.

12. Vertical-axis air classifier according to claim 11, wherein a seal is located between the fines discharge chamber and classifying chamber in said transition zone between the support and the rotor.

13. Vertical-axis air classifier according to claim 12, wherein said seal is one which can be rinsed with a fluid.

14. Vertical-axis air classifier according to claim 13, wherein said seal is arranged axially of said drive shaft.

15. Vertical-axis air classifier according to claim 13, wherein said seal is arranged radially of said drive shaft.

16. At Vertical-axis air classifier according to claim 1, further comprising at least one helix member located within the classifying chamber and extending coaxially of said rotor axis.

17. Vertical-axis air classifier according to claim 16, wherein said helix member is fastened to said inside surface of the stationary guide vane ring.

18. Vertical-axis air classifier according to claim 1, wherein an annular disc, which rotates within the coarse material discharge chamber, is located under the classifying wheel.

19. Vertical-axis air classifier according to claim 18, wherein the rotating annular disc is connected firmly to the rotor.

20. Vertical-axis air classifier according to claim 19, wherein the annular disc extends radially over an inner side wall of the annular-shaped coarse material discharge chamber and a floor of the coarse material discharge chamber.

21. Vertical-axis air classifier according to claim 20, wherein a channel to accommodate a fluid flow to permit fluidization of the coarse material is located between the floor of the coarse material discharge chamber and the annular disc.

22. Vertical-axis air classifier according to claim 21, wherein a stationary retaining ring for the coarse material is located coaxially to the rotating annular disc and connected fry to a housing of the classifier.

23. An air classifier comprising:

a) a rotor having an inside flow zone for separating fine and coarse material;

b) an air supply inlet associated to said rotor and configured for supplying air to the flow zone; and c) a drive shaft having a draft shaft axis and connected with the rotor for providing torque to said rotor;

wherein the drive shaft has a hollow portion along the drive shaft axis and in fluid communication with the rotor and having at least one aperture for permitting the flow and discharge of separated material from the flow zone therethrough.

* * * * *

UNITED STATES PATENT AND TRADEMARK OFFICE

CERTIFICATE OF CORRECTION

PATENT NO. : 6,109,448
DATED : August 29, 2000
INVENTOR(S) : Konetzka et al.

It is certified that error appears in the above-identified patent and that said Letters Patent is hereby corrected as shown below:

Title page,
[75] Inventors, change "Marcus Alex Heinrich Adam" to -- Marcus Alexis Heinrich Adam --.

Column 8,
Line 11 (claim 11, line 1), delete "At".
Line 25 (claim 16, line 1), delete "At".
Line 52 (claim 22, line 4), change "fry" to -- firmly --.

Signed and Sealed this

Eighteenth Day of September, 2001

*Attest:*

Nicholas P. Godici

NICHOLAS P. GODICI
*Acting Director of the United States Patent and Trademark Office*

*Attesting Officer*